US011006809B2

(12) United States Patent
Li

(10) Patent No.: US 11,006,809 B2
(45) Date of Patent: May 18, 2021

(54) WATER-SPRAYING MOP

(71) Applicant: JIAXING JACKSON TRAVEL PRODUCTS CO., LTD., Zhejiang (CN)

(72) Inventor: Jing Li, Zhejiang (CN)

(73) Assignee: JIAXING JACKSON TRAVEL PRODUCTS CO., LTD.

( * ) Notice: Subject to any disclaimer, the term of this patent is extended or adjusted under 35 U.S.C. 154(b) by 308 days.

(21) Appl. No.: 15/693,225

(22) Filed: Aug. 31, 2017

(65) Prior Publication Data

US 2018/0055327 A1 Mar. 1, 2018

(30) Foreign Application Priority Data

| | | |
|---|---|---|
| Aug. 31, 2016 | (CN) | 201621027846.5 |
| Nov. 3, 2016 | (CN) | 201621182337.X |
| Nov. 28, 2016 | (CN) | 201621279997.X |
| Jan. 22, 2017 | (CN) | 201720092015.4 |
| Jan. 22, 2017 | (CN) | 201720092530.2 |

(51) Int. Cl.

| | |
|---|---|
| ***A47L 13/22*** | (2006.01) |
| ***A47L 13/14*** | (2006.01) |
| ***A47L 13/256*** | (2006.01) |

(52) U.S. Cl.

CPC ..... *A47L 13/22* (2013.01); *A47L 13/14* (2013.01); *A47L 13/256* (2013.01)

(58) Field of Classification Search

CPC ..... A47L 13/22; A47L 13/14; A47L 13/256; A47L 13/24; A47L 13/254; A47L 13/255; A47L 13/257; A47L 13/258

See application file for complete search history.

(56) References Cited

U.S. PATENT DOCUMENTS

| | | | | | |
|---|---|---|---|---|---|
| 2,310,006 | A * | 2/1943 | Wisner | A47L 13/22 | 15/244.1 |
| 2,770,828 | A * | 11/1956 | Ellman | A47L 13/22 | 15/244.1 |
| 5,084,938 | A * | 2/1992 | Knestele | A47L 11/34 | 15/98 |
| 5,735,620 | A * | 4/1998 | Ford | A46B 5/0075 | 401/24 |
| 5,964,003 | A * | 10/1999 | Rogers | A47L 13/22 | 15/28 |

(Continued)

FOREIGN PATENT DOCUMENTS

| | | | | |
|---|---|---|---|---|
| DE | 10358467 | * | 7/2005 | A47L 13/22 |
| WO | WO2017080532 | * | 5/2017 | A47L 13/22 |

*Primary Examiner* — J C Jacyna

(57) ABSTRACT

A water-spraying mop comprising a mop rod, a mop head and a universal joint that rotationally connects the mop head and the mop rod; the mop rod comprises a water-squeezing frame that is disposed on the mop rod, and is capable of moving relative to the mop rod in an axial direction; the water-squeezing frame comprises a channel for allowing the mop head to pass through, a water-squeezing portion that is disposed in the channel, and faces the mop cloth while the mop head passes through the channel, and a liquid-spraying system consisted of a water tank, a water pump and a dynamic mechanism used for propelling the water pump to spray liquid; the water tank is disposed at the mop head, and the water pump is disposed in the mop rod.

25 Claims, 21 Drawing Sheets

(56) References Cited

U.S. PATENT DOCUMENTS

| | | | | |
|---|---|---|---|---|
| 8,534,301 | B2 * | 9/2013 | Nottingham | A47L 13/22<br>134/105 |
| 9,872,595 | B2 * | 1/2018 | Hansen | B08B 1/00 |
| 9,962,057 | B2 * | 5/2018 | Dingert | A47L 13/22 |
| 2005/0271456 | A1 * | 12/2005 | Suda | A47L 13/22<br>401/139 |
| 2006/0204316 | A1 * | 9/2006 | Sacks | A47L 13/22<br>401/139 |
| 2006/0269353 | A1 * | 11/2006 | Tanaka | A47L 13/22<br>401/146 |
| 2008/0205972 | A1 * | 8/2008 | LaFlamme | A47L 13/22<br>401/270 |
| 2010/0088932 | A1 * | 4/2010 | Rosenzweig | A47L 11/34<br>38/77.8 |

* cited by examiner

WATER-SPRAYING MOP

TECHNICAL FIELD OF THE INVENTION

The present invention relates to the technical field of cleaning products, and more particularly, to a water-spraying mop having a self-cleaning performance.

BACKGROUND OF THE INVENTION

Chinese patent CN204541992U discloses a water-spraying mop comprising a mop rod. The lower end of the mop rod is connected to a mop head, and the lower portion of the mop head is provided with a mop cloth. Furthermore, the lower portion of the mop rod is provided with a water-spraying apparatus. The water-spraying apparatus comprises a water-spraying mouth and a water-storing pot. The upper end of the mop rod is provided with an armrest, and a switch used for controlling the water-spraying apparatus is disposed on the armrest. The water-spraying mouth is a high pressure fine atomizing nozzle, and the water-spraying direction is angled towards the front of the mop head. However, the mop rod and the mop head of such a traditional water-spraying mop need to be rotated and bent during use, making the water-spraying pipeline easily squeezable. Thus, the obstructed pipeline can lead to a low stability of spraying water.

SUMMARY OF THE INVENTION

The purpose of the present invention is to solve the shortcomings in the prior art and provide a water-spraying mop having a simple structure, which allows the water to be smoothly and stably sprayed during use.

To achieve the above purpose, the present invention adopts the following technical solution:

A water-spraying mop comprising a mop rod, a mop head, and a universal joint that rotationally connects the mop head and the mop rod; the water-spraying mop further comprises a liquid-spraying system consisted of a water tank, a water pump and a dynamic mechanism used for propelling the water pump to spray liquid; the water tank is disposed at the mop head, and the water pump is disposed in the mop rod; the universal joint comprises an upper connector and a lower connector; one end of the upper connector is fixed to the mop rod, the other end of the upper connector is hinged with one end of the lower connector, and the other end of the lower connector is hinged with the mop head; the mop head is provided with an access hole for allowing the guide pipes to pass through; the water inlet of the water pump and the water tank are connected by a water inlet pipe through the access hole; the middle portion of the lower connector is provided with a first channel for allowing the water inlet pipe to pass through.

In another aspect of the present invention, the middle portion of the upper connector is provided with a second channel for allowing the water inlet pipe to pass through.

In another aspect of the present invention, the water-spraying mop further comprises a water outlet pipe and a sprayer. One end of the water outlet pipe is connected to the water outlet of the water-spraying pump, and the other end of the water outlet pipe passes through the first channel, and is connected to the sprayer disposed on the mop head.

In another aspect of the present invention, the water-spraying mop further comprises a water outlet pipe and a sprayer. One end of the water outlet pipe is connected to the water outlet of the water-spraying pump, and the other end of the water outlet pipe passes through the first channel and the second channel, and is connected to the sprayer disposed on the mop head.

In another aspect of the present invention, the mop rod comprises an upper rod body and a lower rod body. A rod-body connecting structure, which allows the upper rod body and the lower rod body to be jointed or separated, is disposed between the upper rod body and the lower rod body. The dynamic mechanism comprises an upper inner rod that is inserted into the upper rod body, a lower inner rod that is inserted into the lower rod body, and a control mechanism capable of propelling the upper inner rod to move in an axial direction. An elastic reset mechanism, which enables the lower inner rod moving downwardly in an axial direction to recover to the original position, is connected to the lower rod body or the lower inner rod. After the upper rod body and the lower rod body are jointed through the rod-body connecting structure, the control mechanism can propel the upper inner rod and the lower inner rod to move together.

In another aspect of the present invention, the side portion of the lower end of the lower rod body is provided with an operating hole. An operating body is horizontally disposed in the lower rod body. One end of the operating body penetrates through the operating hole, and the lower inner rod is connected to the operating body.

In another aspect of the present invention, the operating hole is a long hole extending along the lower rod body in an axial direction. A travelling space is left between the operating body and the lengthwise direction of the operating hole when the operating body is inserted into the operating hole.

In another aspect of the present invention, the elastic reset mechanism comprises a spring that is disposed in the lower rod body. The lower end of the spring acts on the lower rod body, and the upper end of the spring acts on the lower portion of the operating body. The lower end of the lower inner rod acts on the upper portion of the operating body.

In another aspect of the present invention, the mop rod is provided with a liquid-spraying base used for mounting the water pump. A first circumferential single-direction positioning structure, which enables the liquid-spraying base to be circumferentially positioned in a single direction relative to the mop rod so that the orientation of the sprayer can be fixed, is disposed between the liquid-spraying base and the mop rod. The control mechanism comprises a handle body and a trigger. A second circumferential single-direction positioning structure, which enables the handle body to be circumferentially positioned in a single direction relative to the mop rod so that the trigger is enabled to face a direction opposite to the sprayer, is disposed between the handle body and the mop rod.

In another aspect of the present invention, the mop rod comprises an upper rod body and a lower rod body. A third circumferential single-direction positioning structure, which enables the upper rod body to be circumferentially positioned in a single direction relative to the lower rod body, is disposed between the upper rod body and the lower rod body.

In another aspect of the present invention, the first circumferential single-direction positioning structure, the second circumferential single-direction positioning structure and the third circumferential single-direction positioning structure can respectively be one or a combination of the structures selecting from concave-convex type positioning structure, single-direction engagement structure, single-direction plug-in structure and single-direction pin-connection structure.

In another aspect of the present invention, the first circumferential single-direction positioning structure comprises a positioning cylinder body that is disposed at the upper end of the liquid-spraying base. The lower end of the mop rod is inserted in the positioning cylinder body. The inner side of the positioning cylinder body or the lower end of the mop rod is provided with a first positioning convex portion. The inner side of the positioning cylinder body or the lower end of the mop rod is provided with a first positioning concave portion that can be circumferentially positioned with the first positioning convex portion.

In another aspect of the present invention, the first circumferential single-direction positioning structure further comprises a connecting cylinder body that is disposed at the upper portion of the liquid-spraying base and the periphery of the positioning cylinder body. The connecting cylinder body is detachably connected to the liquid-spraying base through a single-direction positioning component.

In another aspect of the present invention, the single-direction positioning component comprises at least one elastic positioning engagement body that is disposed on the liquid-spraying base. A positioning hole, which corresponds to the elastic positioning engagement body, is provided on the connecting cylinder body. The positioning cylinder body is circumferentially provided with a plurality of positioning slots extending along the connecting cylinder body in an axial direction, and the connecting cylinder body is circumferentially provided with a plurality of positioning convex strips that can match the positioning slots.

In another aspect of the present invention, the second circumferential single-direction positioning structure comprises at least one second positioning convex portion that is disposed in the handle body or at the upper portion of the mop rod. The handle body or the upper portion of the mop rod is provided with at least one second positioning concave portion that can coordinate with the second positioning convex portion.

In another aspect of the present invention, the mop rod comprises a water-squeezing frame that is disposed on the mop rod, and is capable of moving relative to the mop rod in an axial direction. The water-squeezing frame comprises a channel for allowing the mop head to pass through, and a water-squeezing portion that is disposed in the channel, and faces the mop cloth while the mop head passes through the channel.

In another aspect of the present invention, the water-squeezing frame is provided with a cleaning fluid discharging portion that is disposed in the channel, and faces the mop cloth while the mop head passes through the channel. The cleaning fluid is stored in the cleaning fluid discharging portion. The cleaning fluid discharging portion can be controlled to provide cleaning fluid to the channel or to the mop cloth while the mop head passes through the channel, thereby thoroughly cleaning the mop cloth.

In another aspect of the present invention, the cleaning fluid discharging portion comprising a liquid outlet that is disposed to correspond to the channel, a liquid-storing unit that is connected to the liquid outlet, and a pair of liquid-supplying control modules that is disposed to correspond to the liquid outlet, and can be selected to be open or closed.

In another aspect of the present invention, the liquid-storing unit is a chamber formed by the water-squeezing frame.

In another aspect of the present invention, the liquid-storing unit is a container attached to the water-squeezing frame.

In another aspect of the present invention, the container is provided with an opening that is disposed to correspond to the liquid outlet. The liquid-supplying control module, which is disposed in the container through the opening, corresponds to the liquid outlet.

In another aspect of the present invention, the liquid-supplying control module comprises a seat tube that corresponds to the opening, and a film sheet that is disposed in the seat tube and faces the opening. The film sheet is provided with a liquid-discharging slit that can be selected to be open or closed. The container is provided with a button that can be controlled to move towards the opening to change the inner volume of the container, and a spring that is disposed between the button and the seat tube for providing a reset force to the button.

In another aspect of the present invention, the water-squeezing frame comprises a mounting port for mounting the container, a mounting slot that is disposed in the mounting port, in which the container can be embedded, and a limiting ring that is disposed on the mounting slot to prevent the button from being separated.

In another aspect of the present invention, the liquid-supplying control module comprises a seat tube that corresponds to the opening, and a film sheet that is disposed in the seat tube and faces the opening. The film sheet is provided with a liquid-discharging slit that can be selected to be open or closed. The container is provided with a button that can be controlled to move towards the opening to change the inner volume of the container, and a spring capable of providing a reset force to the button. One end of the spring is disposed on the button, and the other end of the spring is disposed on the inner wall of a container adjacent to the seat tube.

In another aspect of the present invention, the liquid-discharging direction of the liquid outlet can be perpendicular to the mop cloth or be tilted relative to the mop cloth.

In another aspect of the present invention, the liquid-stopping element can be closed and prohibited from providing cleaning fluid to the mop cloth without being triggered by the mop cloth, and can be open after being triggered to provide cleaning fluid to the mop cloth while the mop cloth passes through the channel.

In another aspect of the present invention, the water-squeezing frame comprises at least one auxiliary rolling wheel that is disposed in the channel, and is in contact with the mop head while the mop head passes through the channel.

In another aspect of the present invention, the mop head is configured to be rectangular. The long edge of the mop head is parallel to the mop rod while the mop head passes through the channel, and the length of the water-squeezing portion located in the channel is not less than that of the short edge of the mop head.

Compared with the prior art, the present invention has the following advantages:

First, the structural design of the pipeline of the water-spraying mop is simple and reasonable, effectively protecting the water-spraying pipeline and allowing the liquid to flow smoothly.

Second, the first circumferential single-direction positioning structure and the second circumferential single-direction positioning structure of the mop rod enable the present invention to be precisely and efficiently assembled, thereby reducing errors in the assembly process. Meanwhile, such a single-direction positioning structure greatly improves the connecting stability between the mop rod and the liquid-spraying base.

Third, the present invention allows the cleaning fluid to be sprayed while the mop head passes through the water-squeezing frame, thus enabling the mop cloth on the mop head to be conveniently cleaned. After being squeezed, the mop head can re-enter into the channel, and cleaning fluid can be re-sprayed to the mop cloth, greatly enhancing the cleaning effect of the water-spraying mop, and making the cleaning fluid easily and conveniently sprayed.

BRIEF DESCRIPTION OF THE DRAWINGS

To clearly expound the present invention or technical solution, the drawings and embodiments are hereinafter combined to illustrate the present invention. Obviously, the drawings are merely some embodiments of the present invention and those skilled in the art can associate themselves with other drawings without paying creative labor.

DETAILED DESCRIPTION OF THE INVENTION

Drawings and detailed embodiments are combined hereinafter to elaborate the technical principles of the present invention.

Embodiment 1

Figure 1:
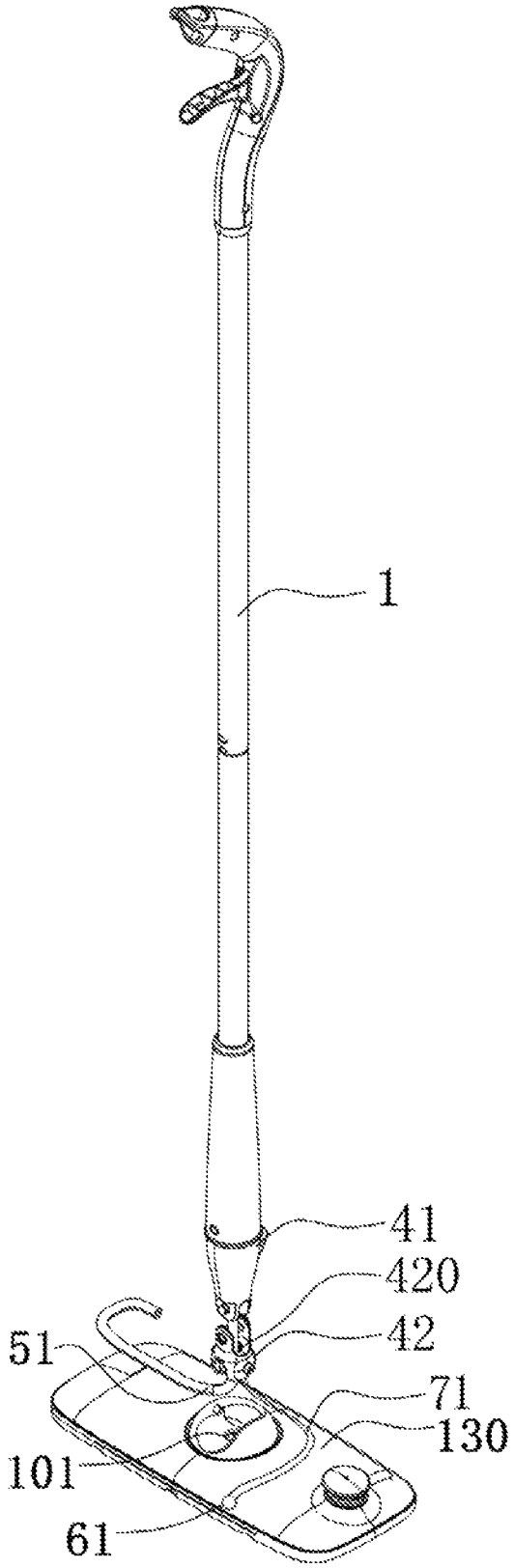
FIG. 1 is a structural diagram of embodiment 1 of the present invention.
Figure 2:
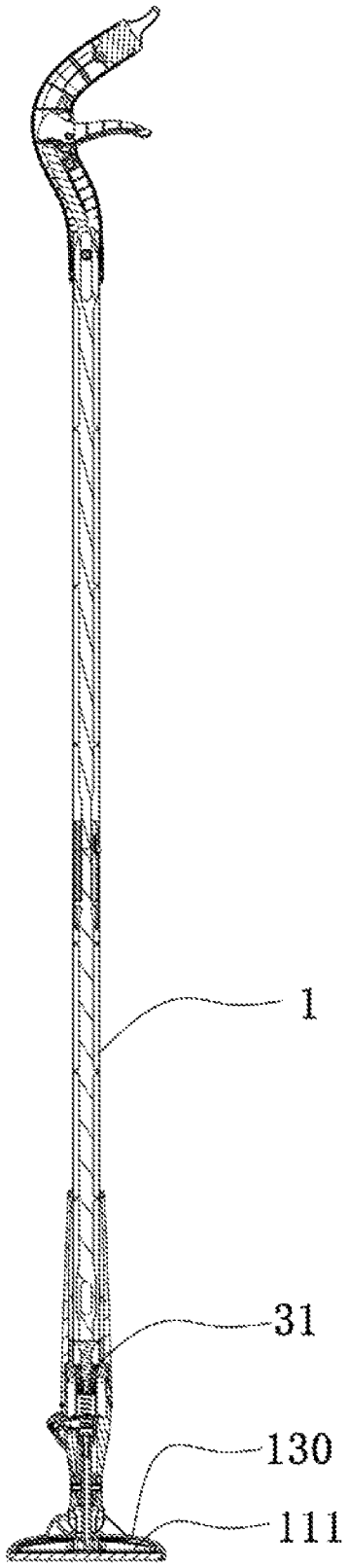
FIG. 2 is a sectional view of FIG. 1.
Figure 3:
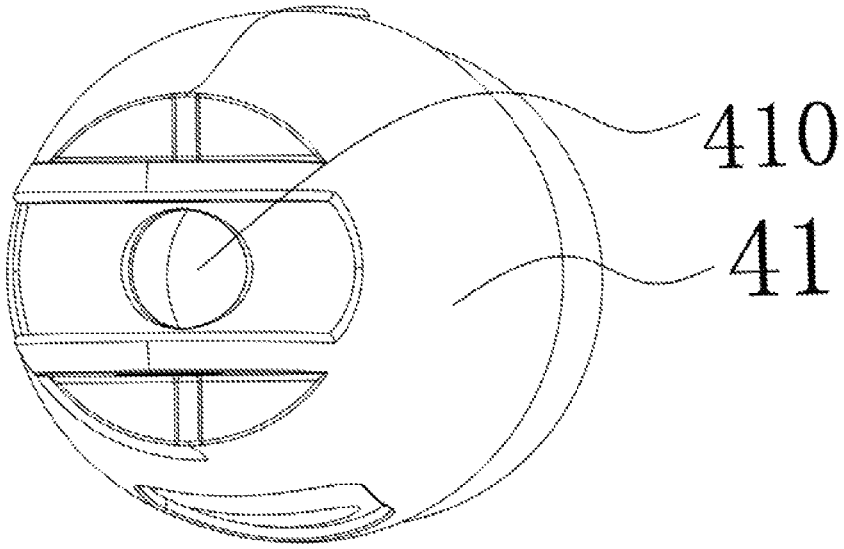
FIG. 3 is a structural diagram of the upper connector of the present invention.
Figure 4:
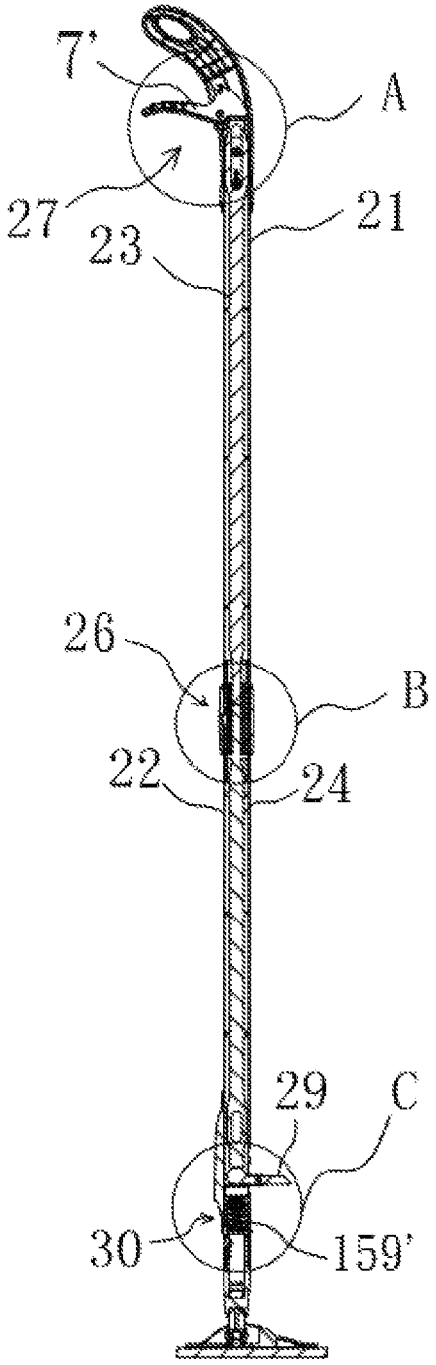
FIG. 4 is a structural diagram of embodiment 2 of the present invention.
Figure 5:
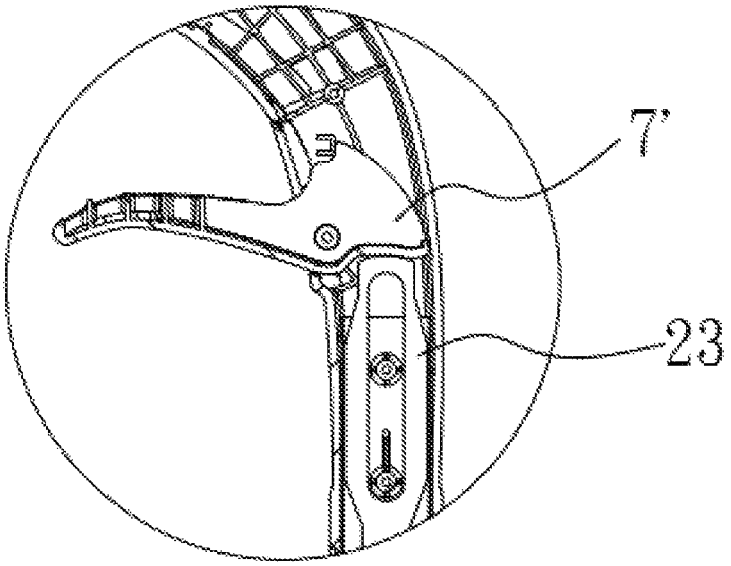
FIG. 5 is an enlarged view of portion 4A in FIG. 5.
Figure 6:
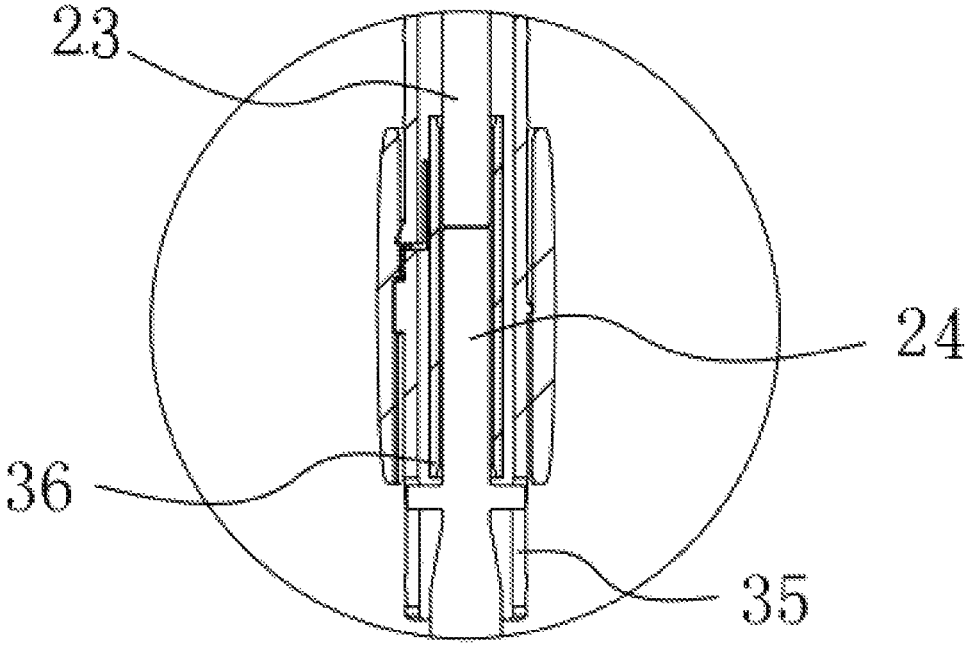
FIG. 6 is an enlarged view of portion 4B in FIG. 6.
Figure 7:
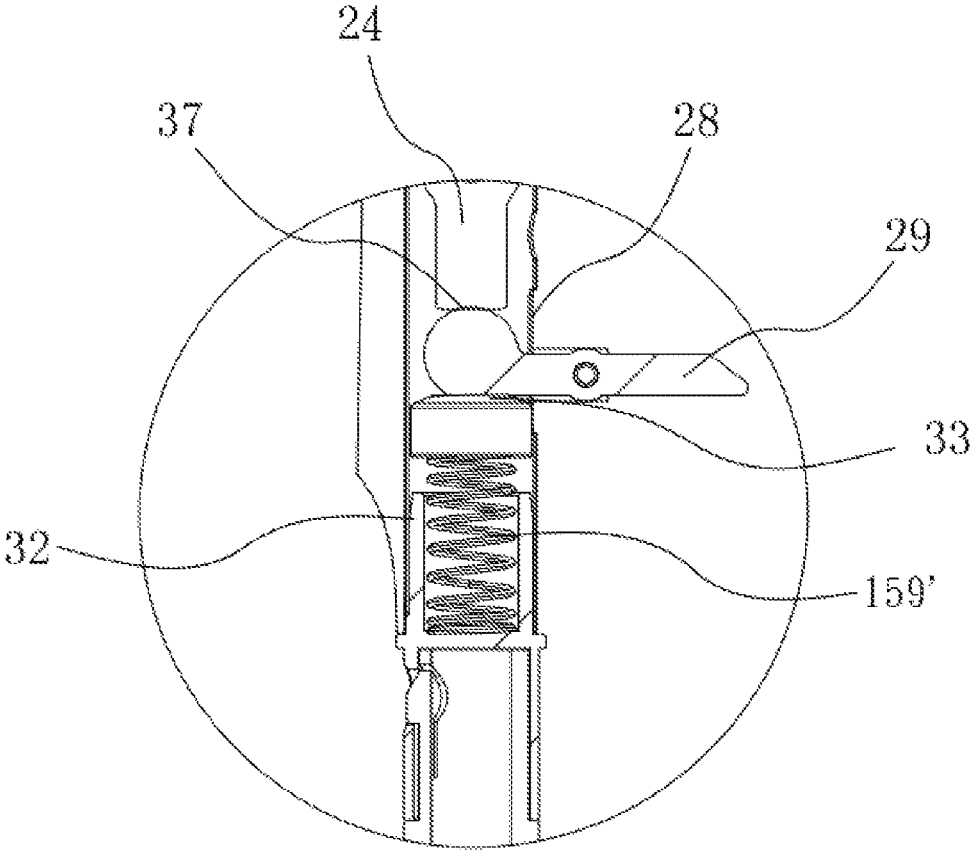
FIG. 7 is an enlarged view of portion 4C in FIG. 7.
Figure 8:
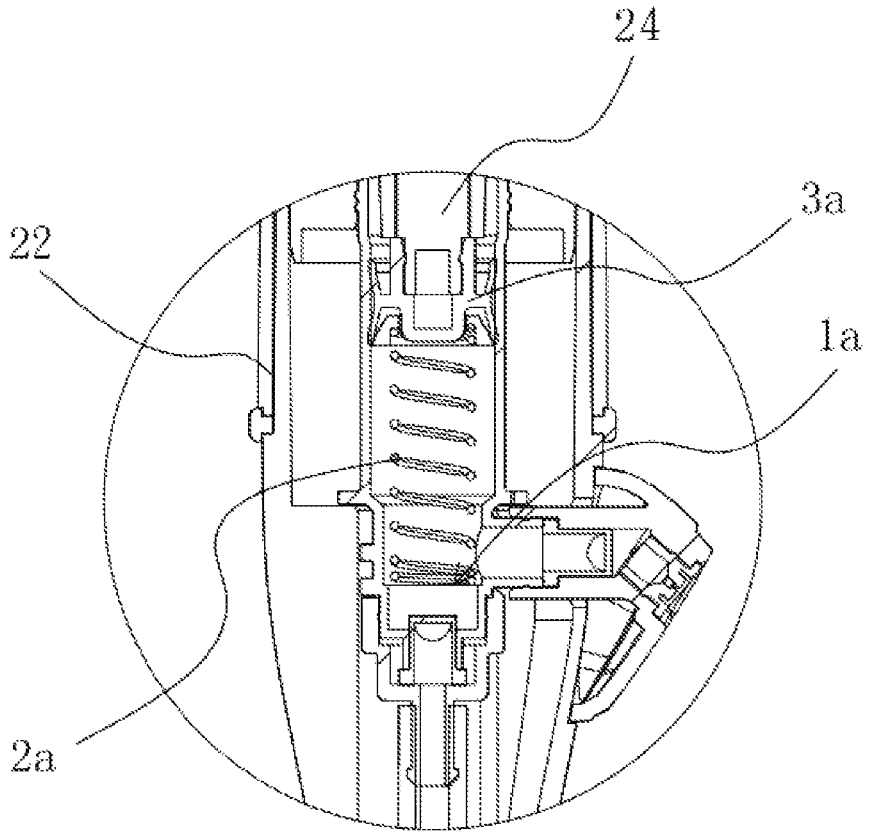
FIG. 8 is a schematic diagram illustrating a structure when the liquid-spraying mechanism of embodiment 2 is located in the lower rod body.
Figure 9:
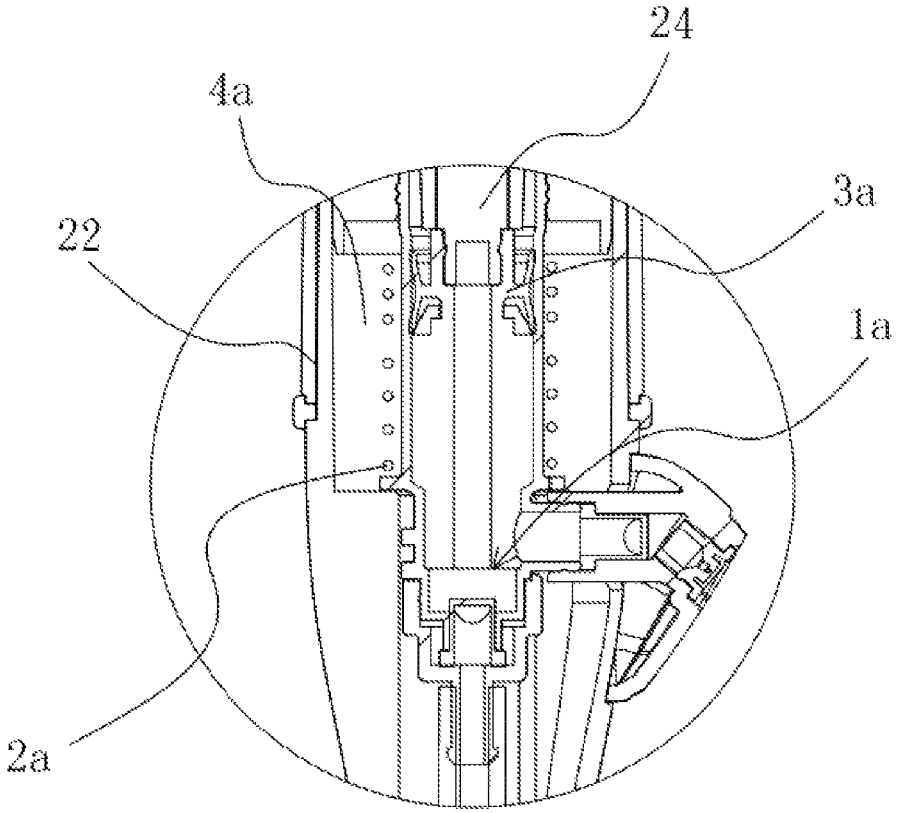
FIG. 9 is another schematic diagram illustrating a structure when the liquid-spraying mechanism of embodiment 2 is located in the lower rod body.
Figure 10:
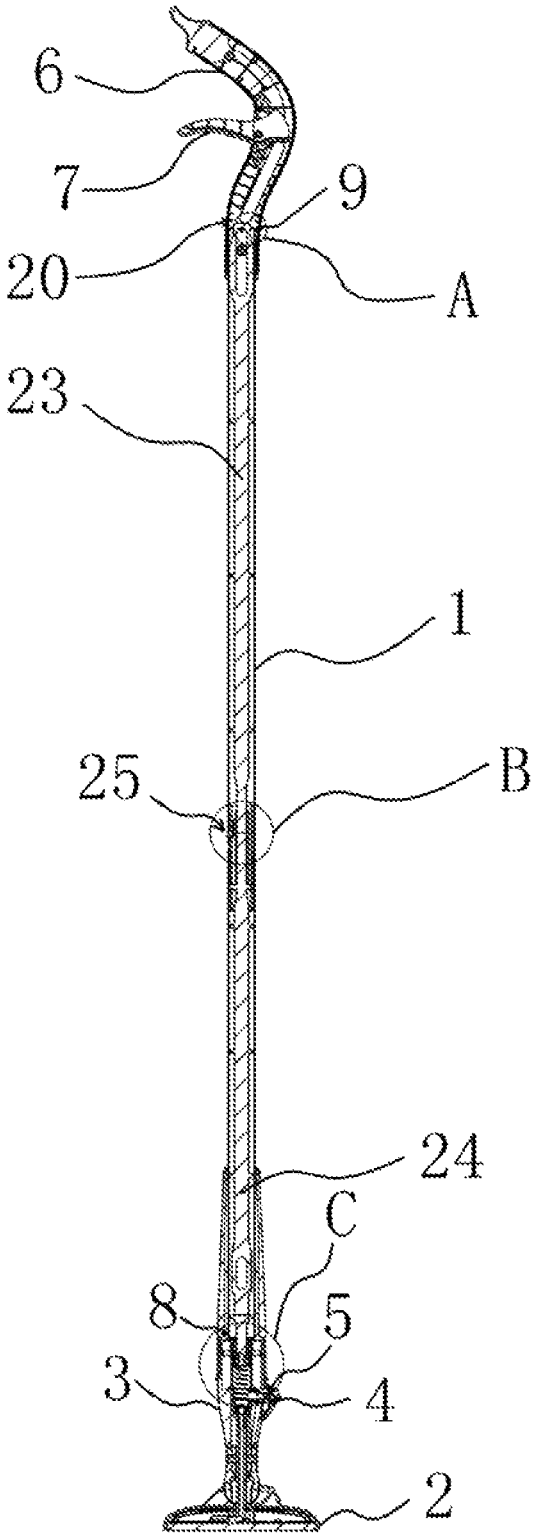
FIG. 10 is a structural diagram of embodiment 3 of the present invention.
Figure 11:
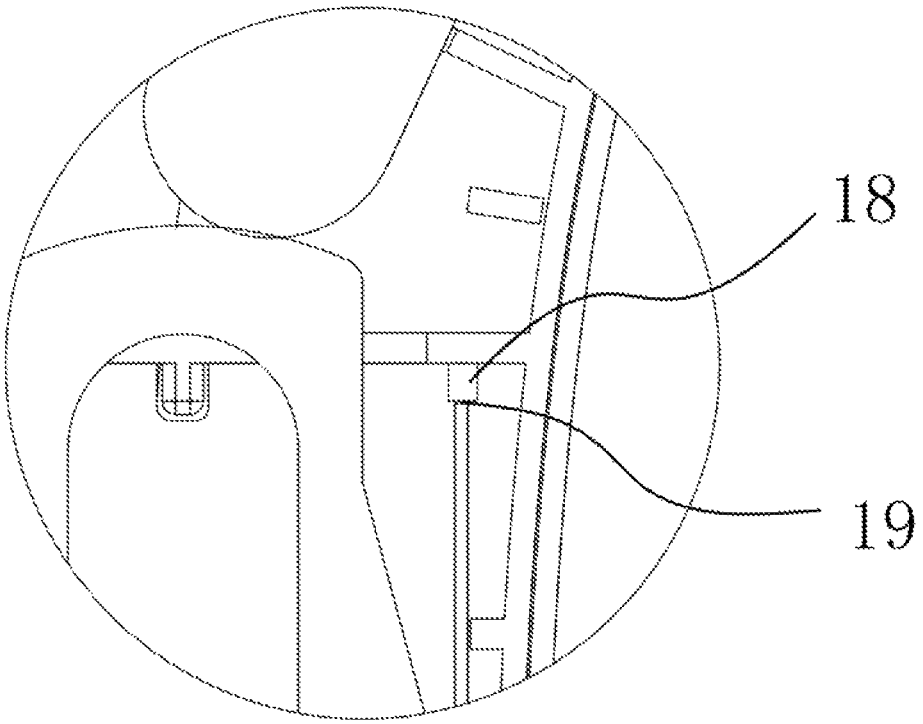
FIG. 11 is an enlarged view of portion A in FIG. 10.
Figure 12:
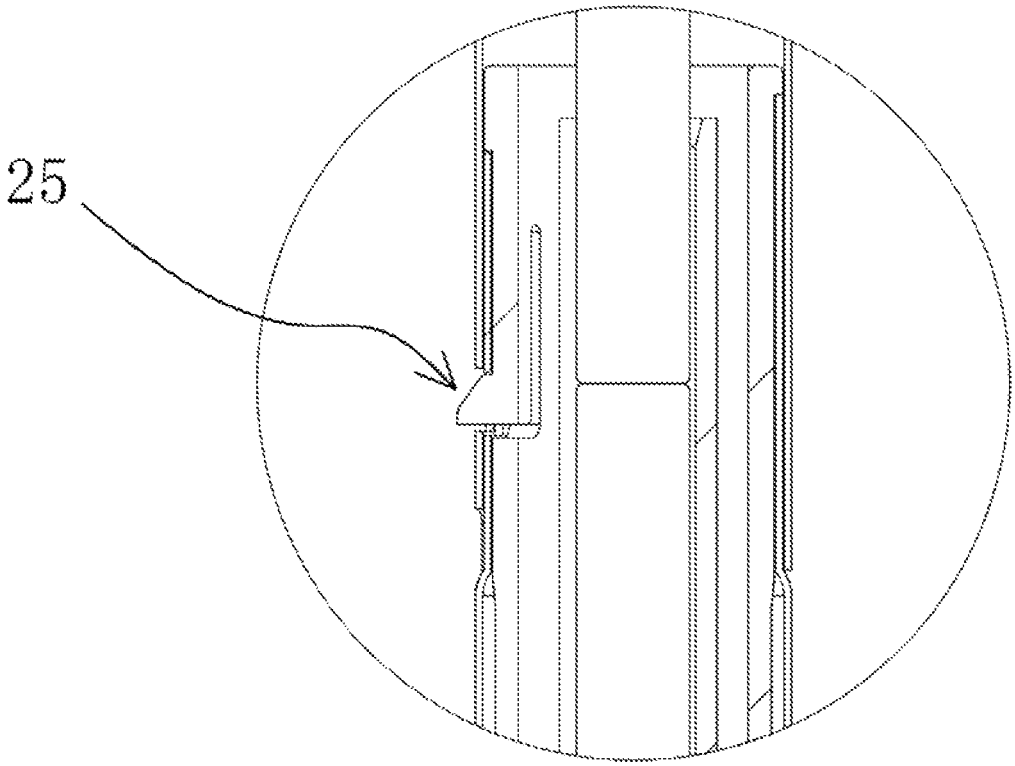
FIG. 12 is an enlarged view of portion B in FIG. 10.
Figure 13:
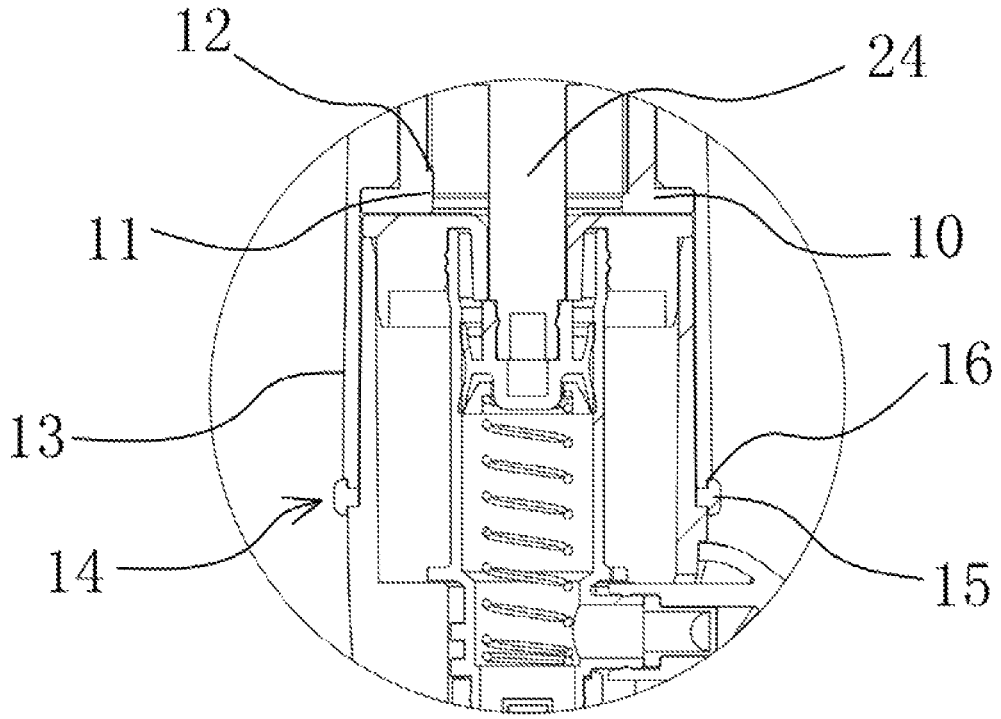
FIG. 13 is an enlarged view of portion C in FIG. 10.
Figure 14:
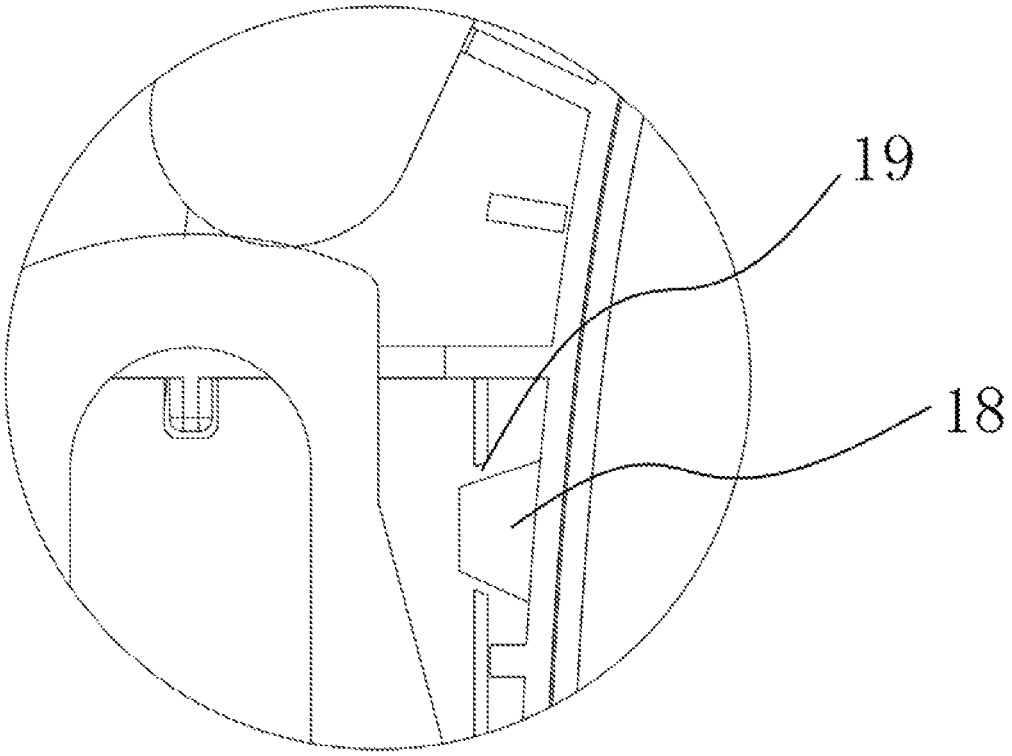
FIG. 14 is a structural diagram of embodiment 3 of the present invention.
Figure 15:
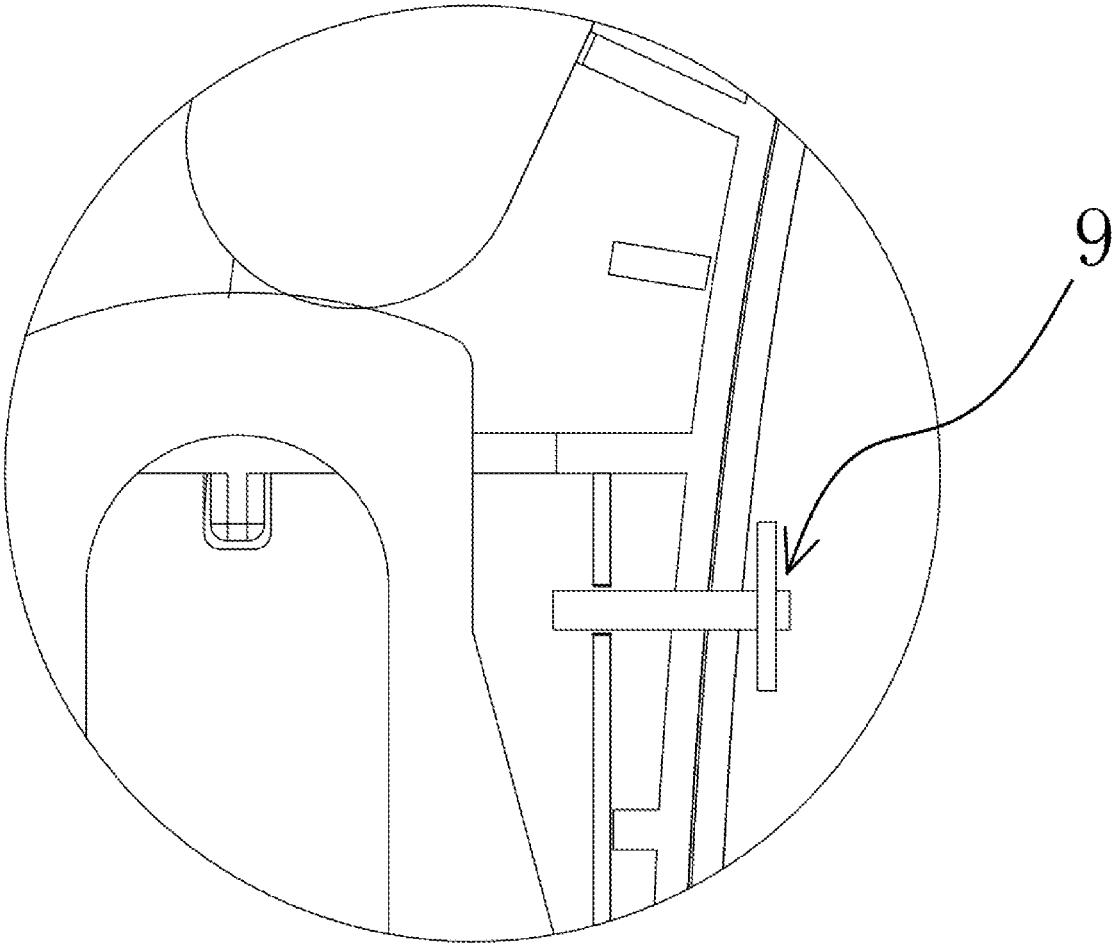
FIG. 15 is another structural diagram of embodiment 3 of the present invention.
Figure 16:
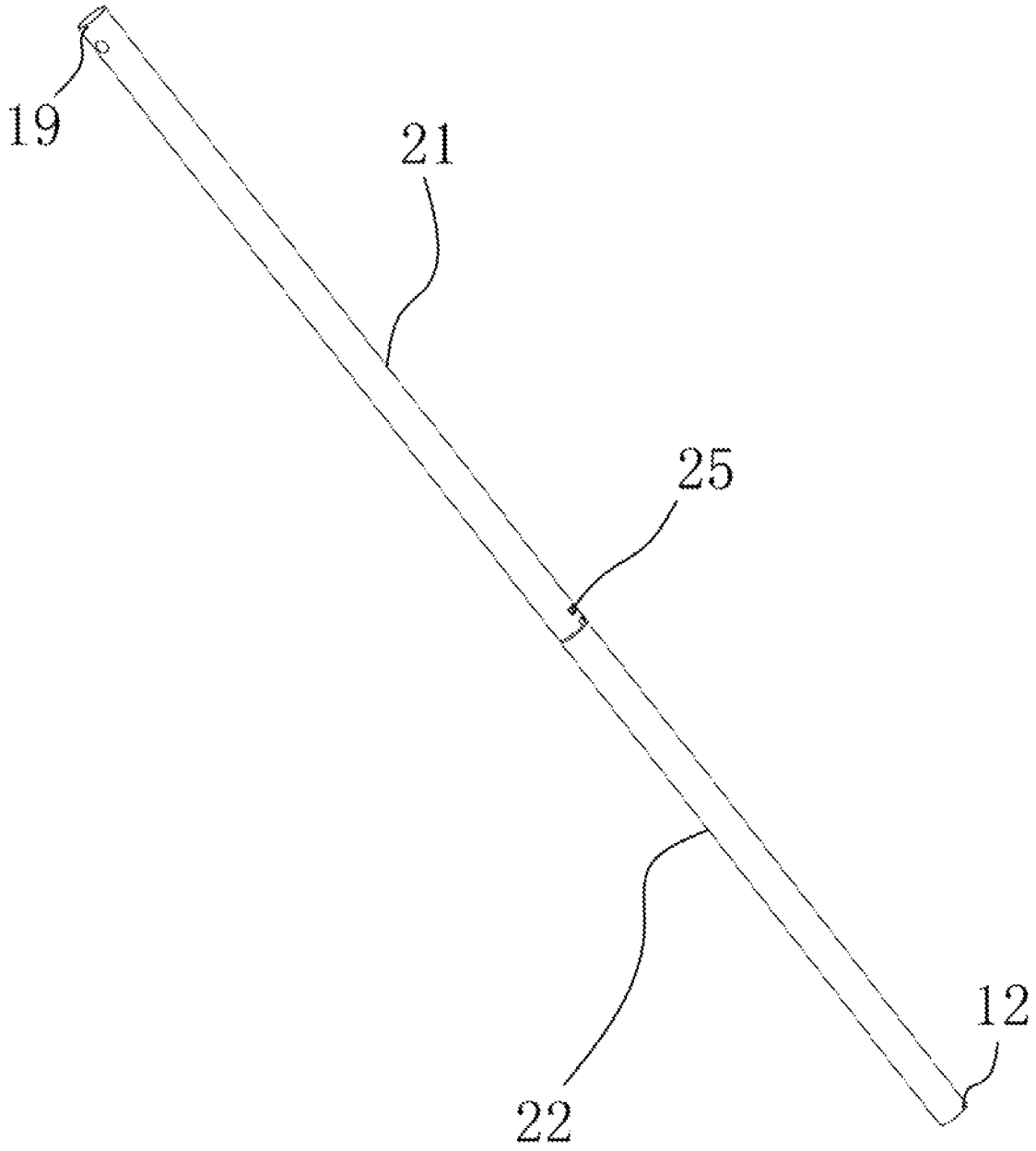
FIG. 16 is another structural diagram of embodiment 3 of the present invention.
Figure 17:
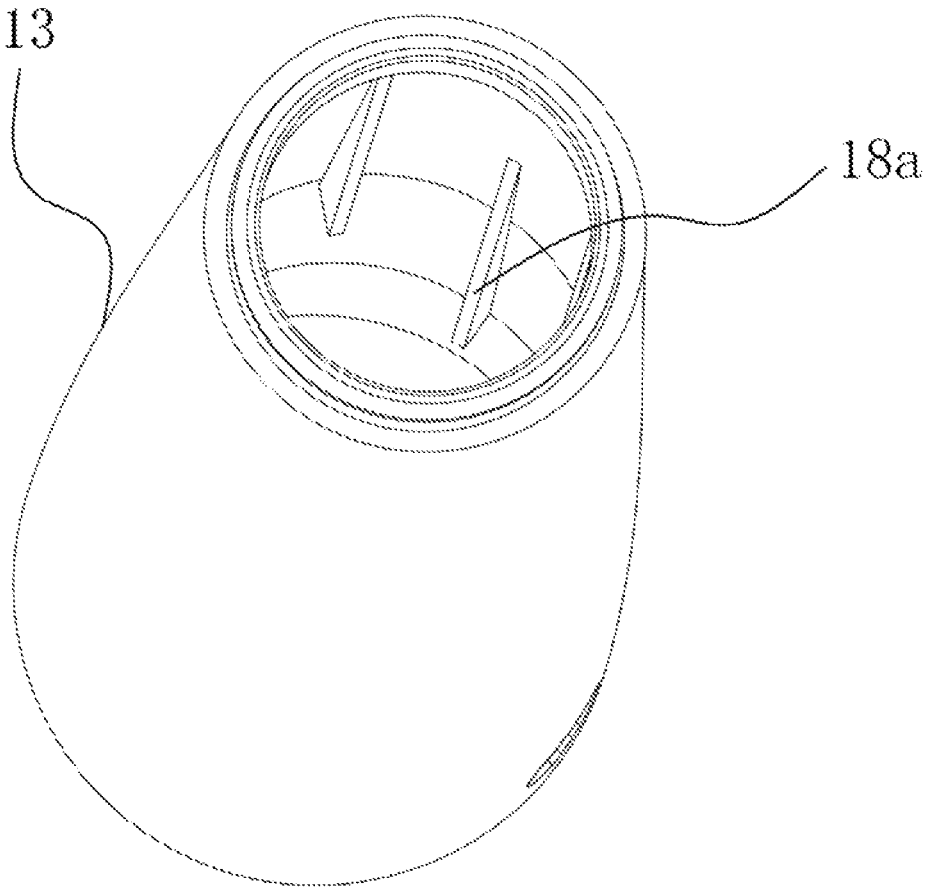
FIG. 17 is another structural diagram of embodiment 3 of the present invention.
Figure 18:
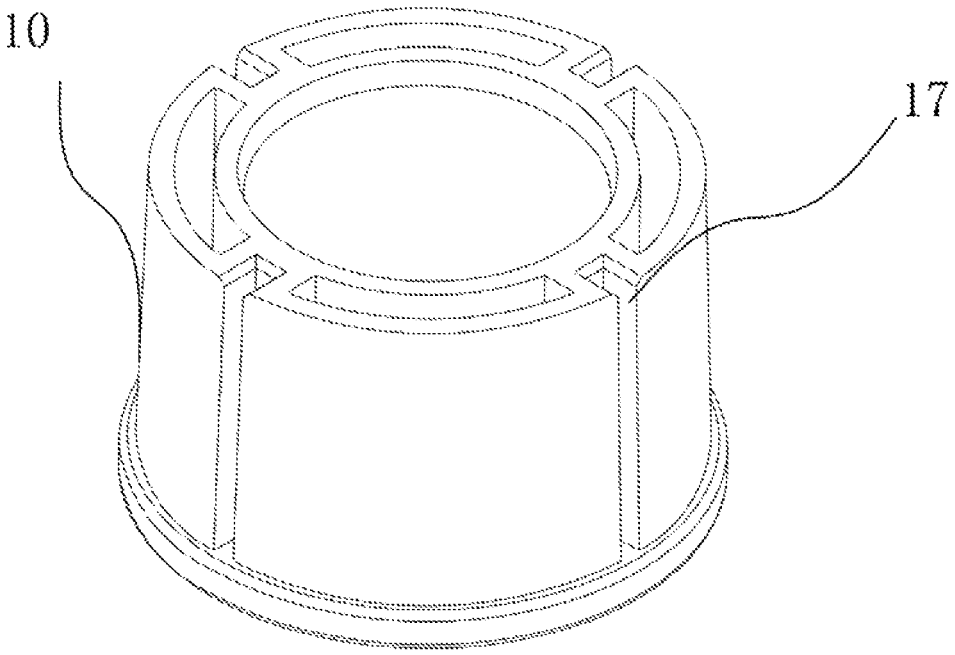
FIG. 18 is another structural diagram of embodiment 3 of the present invention.
Figure 19:
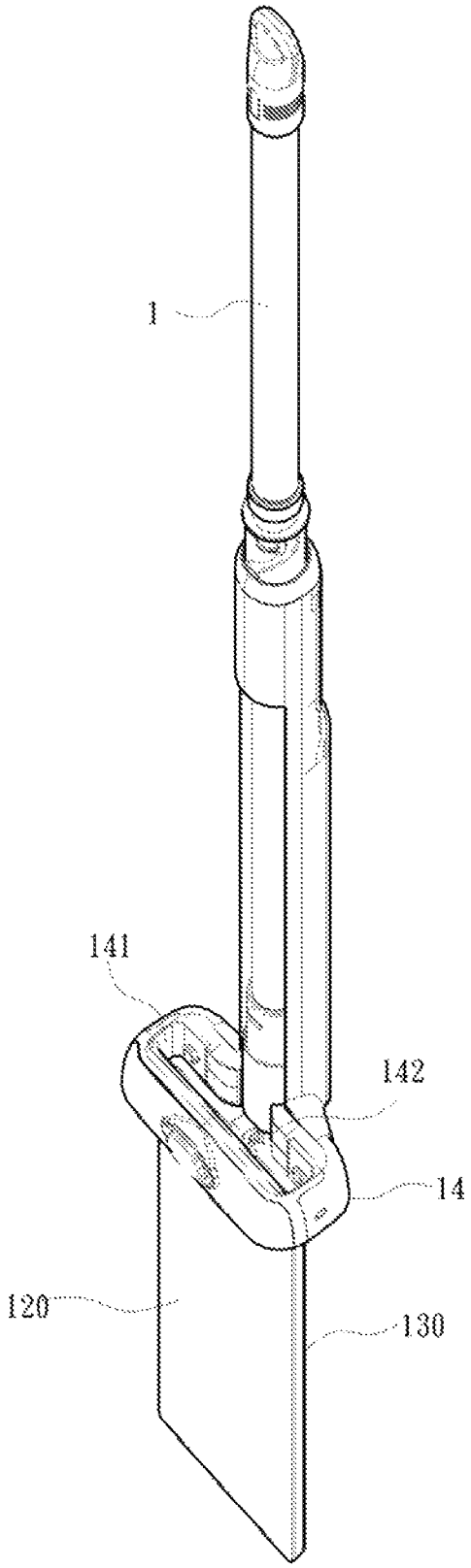
FIG. 19 is a three-dimensional diagram of embodiment 4 of the present invention.
Figure 20:
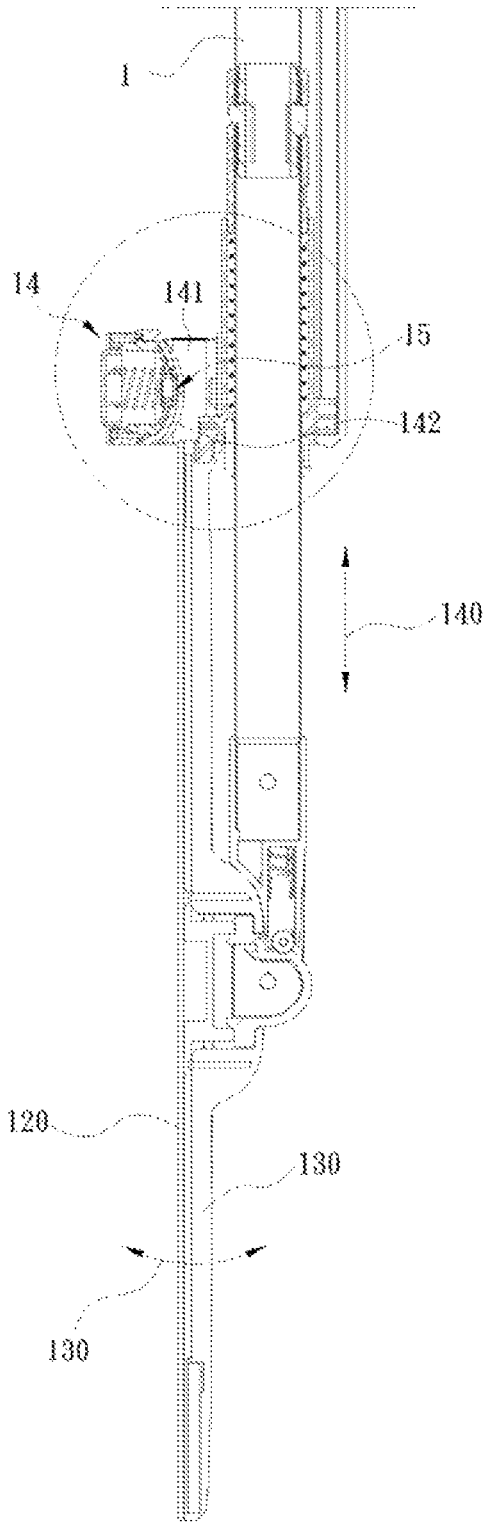
FIG. 20 is a sectional view illustrating a partial structure of embodiment 4 of the present invention.

As shown in FIGS. 1-3, the water-spraying mop comprises a mop head 130, a mop rod 1, a water-spraying pump 31 and a universal connecting mechanism. A water tank 111 is disposed at the mop head 130. The mop head 130 is connected to the mop rod 1, and the water-spraying pump 31 is disposed on the mop rod 1. The mop rod 1 is connected to the mop head 130 through the universal connecting mechanism. The universal connecting mechanism comprises an upper connector 41 and a lower connector 42. One end of the upper connector 41 is fixed to the mop rod 1, and the other of the upper connector 41 is hinged with one end of the lower connector 42. Namely, the upper connector 41 is rotationally connected with the lower connector 42. The other end of the lower connector 42 is hinged with the other end of the mop head 130. One hinged end of the upper connector 41 is perpendicular to the other hinged end of the upper connector 41, thereby achieving a universal movement. The mop head 130 is provided with an access hole 101 for allowing the guide pipes to pass through. The water inlet of the water-spraying pump 31 is connected to the water tank 111 by the water inlet pipe 51 through the access hole 101. When an external force is imposed to the water-spraying pump 31, the water-spraying pump 31 can draw water from the water tank 111 and spray it out. The middle portion of the lower connector 42 is provided with a first channel 420 for allowing the water inlet pipe 51 to pass through. The water inlet pipe 51 is inserted into the first channel 420, and the periphery of a part of the water inlet pipe 51 is surrounded by the first channel 420, thereby limiting the water inlet pipe 51.

Furthermore, the middle portion of the upper connector 41 is provided with a second channel 410 for allowing the water inlet pipe 51 to pass through. The water inlet pipe 51 is simultaneously positioned by the first channel 420 and the second channel 410, making the water inlet pipe 51 be more stable and tidy.

The water-spraying mop of this embodiment further comprises a water outlet pipe 71 and a sprayer 61. One end of the water outlet pipe 71 is connected to the water outlet of the water-spraying pump 31, and the other end of the water outlet pipe 71 passes through the first channel 420, and is connected to the sprayer 61 disposed on the mop head 130. Through the sprayer disposed on the mop head 130, the spraying direction can be precisely positioned.

This embodiment further comprises a water outlet pipe 71 and a sprayer. One end of the water outlet pipe 71 is connected to the water outlet of the water-spraying pump 31, and the other end of the water outlet pipe 71 passes through the first channel 420 and the second channel 410, and is connected to the sprayer 61 disposed on the mop head 130. Both the water inlet pipe 51 and the water outlet pipe 71 can be disposed in the first channel 420 and/or the second channel 410, enabling the whole structure to be clean and tidy. Meanwhile, the periphery of the guide pipes can be protected, achieving a higher stability.

When the mop rod 1 is located in a vertical direction, the center of the access hole, the center of the first channel and the center of the second channel are kept in line. The center of the access hole, the center of the first channel and the center of the second channel are all the passing paths of the water inlet pipe 51 and the water outlet pipe 71. When the three centers are kept in line, the pipeline can become more unobstructed and tidy.

Embodiment 2

As shown in FIGS. 4-9, the water-spraying mop 1 is a structure composed of jointed rod bodies. The mop rod 1 comprises an upper rod body 21 and a lower rod body 22.

A rod body connecting structure 26, which enables the upper rod body 21 and the lower rod body 22 to be jointed or separated, is disposed between the upper rod body 21 and the lower rod body 22. An upper inner rod 23 is inserted into the upper rod body 21, and a lower inner rod 24 is disposed in the lower rod body 22. A control mechanism 27, which can propel the upper inner rod 23 to move in an axial direction, is disposed between the upper rod body 21 and the upper inner rod 23. An elastic reset mechanism 30, which enables the lower inner rod 24 moving downwardly in an axial direction to recover to the original position, is connected to the lower rod body 22 or the lower inner rod 24. After the upper rod body 21 and the lower rod body 22 are jointed through the rod-body connecting structure 26, the upper inner rod 23 and the lower inner rod 24 can move together. The upper rod body 21 and the lower rod body 22 can be jointed or separated through the rod-body connecting structure 26, effectively decreasing the length of the water-spraying mop during transportation. Thus, the water-spraying mop of the present invention can be conveniently shipped. Meanwhile, after the upper rod body 21 and the lower rod body 22 are jointed, the upper rod body 21 enables the upper inner rod 23 to press the lower inner rod 24 to spray liquid through the control mechanism 27. When the lower inner rod 24 is pressed by the upper inner rod 23, the elastic reset mechanism 30 can make the lower inner rod 24 move upwardly in an axial direction to recover to the original position. By means of the control mechanism 27 and the elastic reset mechanism 30, the transmission stability and operating convenience of the present invention can be greatly improved.

Specifically, the side portion of the lower end of the lower rod body 22 in this jointed rod-body structure is provided with an operating hole 28. An operating body 29 is horizontally disposed in the lower rod body 22. One end of the operating body 29 penetrates through the operating hole 28, and is connected to the lower inner rod 24. The operating hole 28 is a long-type hole extending along the lower rod body 22 in an axial direction. When the operating body 29 is inserted into the operating hole 28, a travelling space is left between the operating body 29 and the lengthwise direction of the operating hole 28. When the operating body 29 moves downwardly through the lower inner rod 24 in an axial direction, the space formed in the lengthwise direction of the operating hole 28 enables the operating body 29 to smoothly swing under the action of the lower inner rod 24, thereby achieving a stable transmission. Additionally, the elastic reset mechanism 30 comprises a spring 159' that is disposed in the lower rod body 22. The lower end of the spring 159' acts on the lower rod body 22, and the upper end of the spring 159' acts on the lower portion of the operating body 29. The lower end of the lower inner rod 24 acts on the upper portion of the operating body 29.

Further, a cylinder-shaped spring base 32 is disposed in the lower rod body 22, and the operating body 29 is provided with a spring hole 33. One end of the spring 159' is disposed in the spring base 32, and the other end of the spring 159' is disposed in the spring hole 33. In such a configuration, the spring 159' can uniformly impose an acting force to the lower inner rod 24 during the recovering process of the lower inner rod 24. One end of the operating body 29, which is in contact with the lower inner rod 24, is provided with an arc-shaped surface 37. The arc-shaped surface 37 can greatly improve the rotating stability of the operating body 29.

Furthermore, the control mechanism 27 comprises a trigger 7. The inner end of the trigger 7 is disposed in the upper rod body 21, and the outer end of the trigger 7 is disposed outside of the upper rod body. The middle portion of the trigger 7 is rotationally connected to the upper rod body 21. The inner end of the trigger 7 is connected to the upper inner rod 23, and can propel the upper inner rod 23 to move in an axial direction when the trigger 7 is pulled. Thus, pulling the trigger 7 can propel the upper inner rod 23 to move in an axial direction, thereby enabling the upper inner rod 23 to push the lower inner rod 24 to move in an axial direction. Therefore, the movement of the operating body 29 can be realized, and a convenient operation can be achieved. A protecting mechanism for ensuring a stable transmission between the upper inner rod 23 and the lower inner rod 24 after the upper rod body 21 and the lower rod body 22 are jointed is disposed between the lower end of the upper inner rod 23 and the upper end of the lower inner rod 24.

Further, the protecting mechanism comprises an inner pipe body 35 that is disposed at the lower end of the upper rod body 21 and/or the upper end of the lower rod body 22. The lower end of the upper inner rod 23 and the upper end of the lower inner rod 24 are both disposed in the inner pipe body 35, and the lower end of the upper inner rod 23 abuts against the upper end of the lower inner rod 24. A radial convex ring is disposed between the lower end of the upper inner rod 23 and the inner wall of the inner pipe body 35, or a radial convex ring is disposed between the upper end of the lower inner rod 24 and the inner wall of the inner pipe body 35, or radial convex rings are respectively disposed between the inner wall of the inner pipe body 35 and both of the lower end of the upper inner rod 23 and the upper end of the lower inner rod 24. A portion of the upper inner rod 23 and the lower inner rod 24 passes through the radial convex ring 36, and is disposed in the inner pipe body 35, Thus, when the lower end of the upper inner rod 23 and the upper end of the lower inner rod 24 are jointed and abut against each other, the transmission stability can be improved and the structural strength can be enhanced. A first axial limiting mechanism that can prevent the upper inner rod 23 from being separated from the upper rod body 21, and a first radial limiting mechanism that can prevent the upper inner rod 23 from disturbing in the upper rod body 21 are provided between the upper rod body 21 and the upper inner rod 23. A second axial limiting mechanism for protecting the lower inner rod 24 from being separated from the lower rod body 22, and a second radial limiting mechanism for preventing the lower inner rod 24 from disturbing in the lower rod body 22 are provided between the lower rod body 22 and the lower inner rod 24.

Preferably, the aforesaid elastic reset mechanism 30 comprises an embedded-type liquid-spraying mechanism 1*a* that is disposed underneath the lower inner rod 24. The embedded-type liquid-spraying mechanism 1*a* comprises a valve core spring 2*a* and a pressing portion 3*a*. When the pressing portion 3*a* abuts against the lower inner rod 24 and the lower inner rod 24 moves downwardly, the embedded-type liquid-spraying mechanism 1*a* sprays liquid and the lower inner rod has is prone to move upwardly. Such a configuration can effectively reduce the volume of the lower portion of the mop, making the mop be more flexible during the cleaning process. Alternatively, the valve core sparing 2*a* is disposed in the piston 4*a*, thereby reducing the radial displacement of the valve core 2*a*.

Although technical terms such as upper rod body 21, lower rod body 22, rod-body connecting structure 26, upper inner rod 23, lower inner rod 24, control mechanism 27, operating hole 28, operating body 29, elastic reset mechanism 30, spring 159', spring base 21, spring hole 33, trigger 7, inner pipe body 35, radial convex ring 36, arc-shaped surface 37, embedded-type liquid-spraying mechanism 1*a*, valve core spring 2*a*, pressing portion 3*a* and piston 4*a* are frequently used in this embodiment, the possibility of using other technical terms is not excluded. These terms are merely used for illustrating and elaborating the present invention and should not be construed as limiting the scope and spirit of the present invention.

Embodiment 3

As shown in FIGS. 10-18, the mop rod 1 is provided with a liquid-spraying base 3 used for mounting the water pump. A first circumferential single-direction positioning structure 8, which enables the liquid-spraying base 3 to be circumferentially positioned in a single direction relative to the mop rod 1 so that the orientation of the sprayer 4 can be fixed, is disposed between the liquid-spraying base 3 and the mop rod 1. A liquid-spraying mechanism 5 having a sprayer 4 is disposed on the liquid-spraying base 3, and the other end is connected to a handle body 6. One side of the handle body 6 is provided with a trigger 7. The first circumferential single-direction positioning structure 8, which enables the liquid-spraying base 3 to be circumferentially positioned in a single direction relative to the mop rod 1 so that the orientation of the sprayer 4 can be fixed, is disposed between the liquid-spraying base 3 and the mop rod 1. Meanwhile, a second circumferential single-direction positioning structure 9, which enables the handle body 6 to be circumferentially positioned in a single direction relative to the mop rod 1 so that the trigger 7 is enabled to face a direction opposite to the sprayer 4, is disposed between the handle body 6 and the mop rod 1. During assembly, the liquid-spraying base 3 is assembled first to the lower end of the mop rod 1 through the first circumferential single-direction positioning structure 8. Subsequently, the handle body 6 is assembled to the upper end of the mop rod 1 through the second circumferential single-direction positioning structure 9. At this moment, the orientation of the trigger 7 is opposite to that of the sprayer 4, effectively avoiding assembly errors due to the trigger 7 and the sprayer 4 facing a same direction during assembly. Thus, the precision and efficiency of assembly can be greatly improved.

Specifically, the mop rod 1 comprises an upper rod body 21 and a lower rod body 22. A third circumferential single-direction positioning structure 25, which enables the upper rod body 21 to be circumferentially positioned in a single direction relative to the lower rod body 22, is disposed between the upper rod body 21 and the lower rod body 22. The third circumferential single-direction positioning structure 25 enables the upper rod body 21 and the lower rod body 11 to be positioned and jointed. Meanwhile, the first circumferential single-direction positioning structure 8, the second circumferential single-direction positioning structure 9 and the third circumferential single-direction positioning structure 25 can respectively be one or a combination of the structures selecting from concave-convex type positioning structure, single-direction engagement structure, single-direction plug-in structure and single-direction pin-connection structure. The first circumferential single-direction positioning structure 8 comprises a positioning cylinder body 10 that is disposed at the upper end of the liquid-spraying base 3. The lower end of the mop rod 1 is inserted in the positioning cylinder body 10. The inner side of the positioning cylinder body 10 or the lower end of the mop rod 1 is provided with a first positioning convex portion 11. The inner side of the positioning cylinder body 10 or the lower end of the mop rod 1 is provided with a first positioning concave portion 12 that can be circumferentially positioned with the first positioning convex portion 11. During assembly, the liquid-spraying base 3 can merely be jointed with the mop rod 1 when the first positioning convex portion 11 and the first positioning concave portion are circumferentially aligned. Thus, the assembly precision can be ensured. Preferably, when the first circumferential single-direction positioning structure 8 and the second circumferential single-direction positioning structure 9 are single-direction pin-connection structure, two pin holes that are radially opposite to each other are respectively provided at the upper end and the lower end of the mop rod. One pin hole is bigger than the other. The circumference orientation is preliminarily positioned by the pin hole having a larger diameter, and is finally positioned by the pin hole having a smaller diameter.

Further, the first circumferential single-direction positioning structure 8 comprises a connecting cylinder body 13 that is disposed at the upper portion of the liquid-spraying base 3 and the periphery of the locating cylinder body 10. Meanwhile, the connecting cylinder body 13 is detachably connected to the liquid-spraying base 3 through a single-direction positioning component 14. The positioning cylinder body 10 and the liquid-spraying base 3 is circumferentially wrapped by the connecting cylinder body 13, thereby preventing the mop rod 1 from being radially separated from the liquid-spraying base 3. Thus, the connecting stability can be further enhanced. The single-direction positioning component 14 comprises at least one elastic positioning engagement body 15 that is disposed on the liquid-spraying base 3. A positioning hole 16, which corresponds to the elastic positioning engagement body 15, is provided on the connecting cylinder body 13. The positioning cylinder body 10 is circumferentially provided with a plurality of positioning slots 17 extending along the connecting cylinder body 13 in an axial direction. The connecting cylinder body 13 is circumferentially provided with a plurality of positioning convex strips 18*a* that can match the positioning slots 17. The positioning slot 17 and the positioning convex strip 18*a* can avoid a circumferential rotation during use. The single-direction positioning component 14 can realize the disassembly between the connecting cylinder body 13 and the liquid-spraying base 3, allowing the liquid-spraying base to be conveniently maintained. Moreover, the elastic positioning engagement body 15 and the positioning hole 16 can realize the circumferential positioning of the connecting cylinder body 13, ensuring a stable connection of the present invention.

Additionally, the second circumferential single-directional positioning structure 9 comprises at least one second positioning convex portion 18 that is disposed in the handle body 6 or disposed at the upper portion of the mop rod 1. The handle body 6 or the upper portion of the mop rod 1 is provided with at least one second positioning concave portion 19 that can coordinate with the second positioning convex portion 18. The water-spraying mechanism 5 is linked to the trigger 7 through the control mechanism 20, and the shadow casted by the liquid-spraying direction of the sprayer 4 on the mop head 130 is perpendicular to the long axis direction of the mop head 130. Consequently, the sweeping area can be increased while spraying water, greatly improving the cleaning efficiency.

The aforesaid control mechanism 20 comprises an upper rod body 21 and a lower rod body 22 that can be jointed to form the mop rod. An upper inner rod 23 that is linked with the trigger is disposed in the upper rod body 21, and a lower inner rod 24 that is linked with the liquid-spraying mechanism is disposed in the lower rod body 22. When the upper rod body 21 and the lower rod body 22 are jointed, the upper inner rod 23 abuts against the lower inner rod 24.

Although technical terms such as mop rod 1, mop head 130, liquid-spraying base 3, sprayer 4, liquid-spraying mechanism 5, handle body 6, trigger 7, the first circumferential single-direction positioning structure 8, the second circumferential single-direction positioning structure 9, positioning cylinder body 10, the first positioning convex portion 11, the first positioning concave portion 11, connecting cylinder body 13, single-direction positioning component 14, elastic positioning engagement body 15, positioning hole 16, positioning slot 17, positioning convex strip 18*a*, the second positioning convex portion 18, the second positioning concave portion 19, control mechanism 20, upper rod body 21, lower rod body 22, upper inner rod 23, lower inner rod 24 and the third circumferential single-direction positioning structure 25 are frequently used in this embodiment, the possibility of using other technical terms is not excluded. These terms are merely used for illustrating and elaborating the present invention and should not be construed as limiting the scope and spirit of the present invention.

Embodiment 4

As shown in FIGS. 19-22, the water-spraying mop 100 of the present invention comprises a mop rod 1, and a mop head 130 that is connected to the mop rod 1, can rotate relative to the mop rod 1 for a rotating distance 130, and is provided with a mop cloth 120. The mop rod 1 comprises a water-squeezing frame 14 that is disposed on the mop rod 1, and is capable of moving relative to the mop rod 1 for a distance 140 in an axial direction; the water-squeezing frame 14 comprises a channel 141 for allowing the mop head 130 to pass through, a water-squeezing portion 142 that is disposed in the channel 141, and faces the mop cloth 120 while the mop head 130 passes through the channel 141. Further, the water-squeezing frame 14 of the present invention is provided with a cleaning fluid discharging portion 15 that is disposed in the channel 141, and faces the mop cloth 120 while the mop head 130 passes through the channel 141. The cleaning fluid (not shown) is stored in the cleaning fluid discharging portion 15. The cleaning fluid discharging portion 15 can be controlled to provide cleaning fluid to the channel 141 or to the mop cloth 120 while the mop head 130 passes through the channel 141, thereby thoroughly cleaning the mop cloth 120.

Furthermore, the mop head 130 of the present invention is configured to be rectangular. When preparing to squeeze water, the mop head 130 is rotated relative to the mop rod for a rotating distance 130, thereby enabling the long edge of the mop head 130 to be parallel to the axial direction of the mop rod 1. Subsequently, the water-squeezing frame 14 can be pushed to travel along the mop rod 1 for a distance 140 in an axial direction. During the travelling of the water-squeezing frame 14, the mop head 130 is enabled to pass through the channel 141 and is squeezed by the water-squeezing portion 142. When the mop head 130 passes through the channel 141, the cleaning fluid discharging portion 15 can provide cleaning fluid to the mop cloth 120, thereby enabling the mop cloth 120 to be thoroughly cleaned during the water-squeezing process. Once the water-squeezing frame finishes squeezing the mop cloth 120 after travelling the distance 140, it can be enabled to re-travel the axial distance 140 and returned to the original position. The cleaning fluid discharging portion 15 can re-provide cleaning fluid to the mop cloth 120 while the mop portion 12 re-enters into the channel 141. Thus, the mop cloth 120 can be moistened by the cleaning fluid, effectively improving the cleaning effect of the mop cloth 120.

Figure 21:
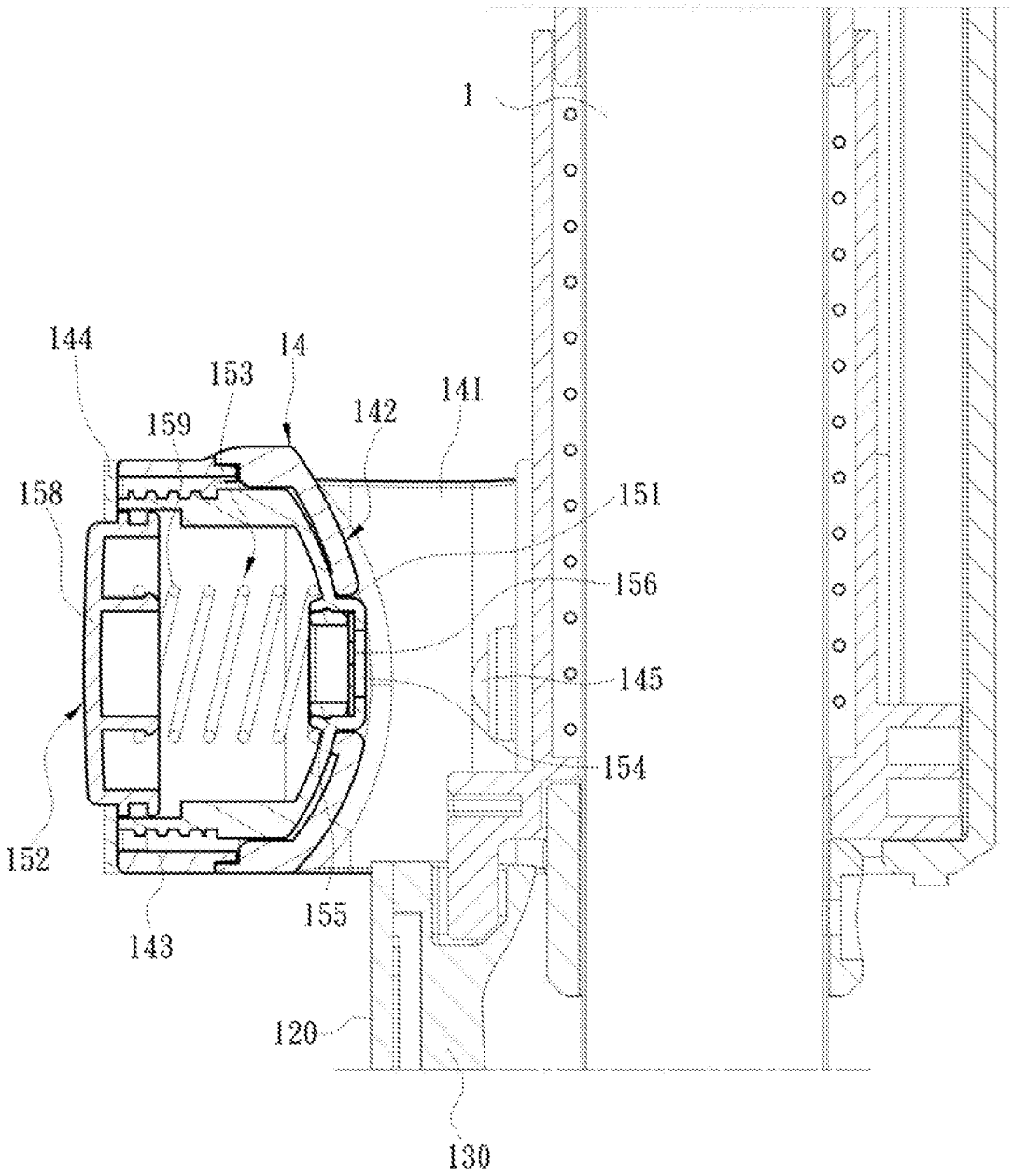
FIG. 21 is an implementation schematic diagram illustrating a partial sectional structure of embodiment 4 of the present invention.
Figure 22:
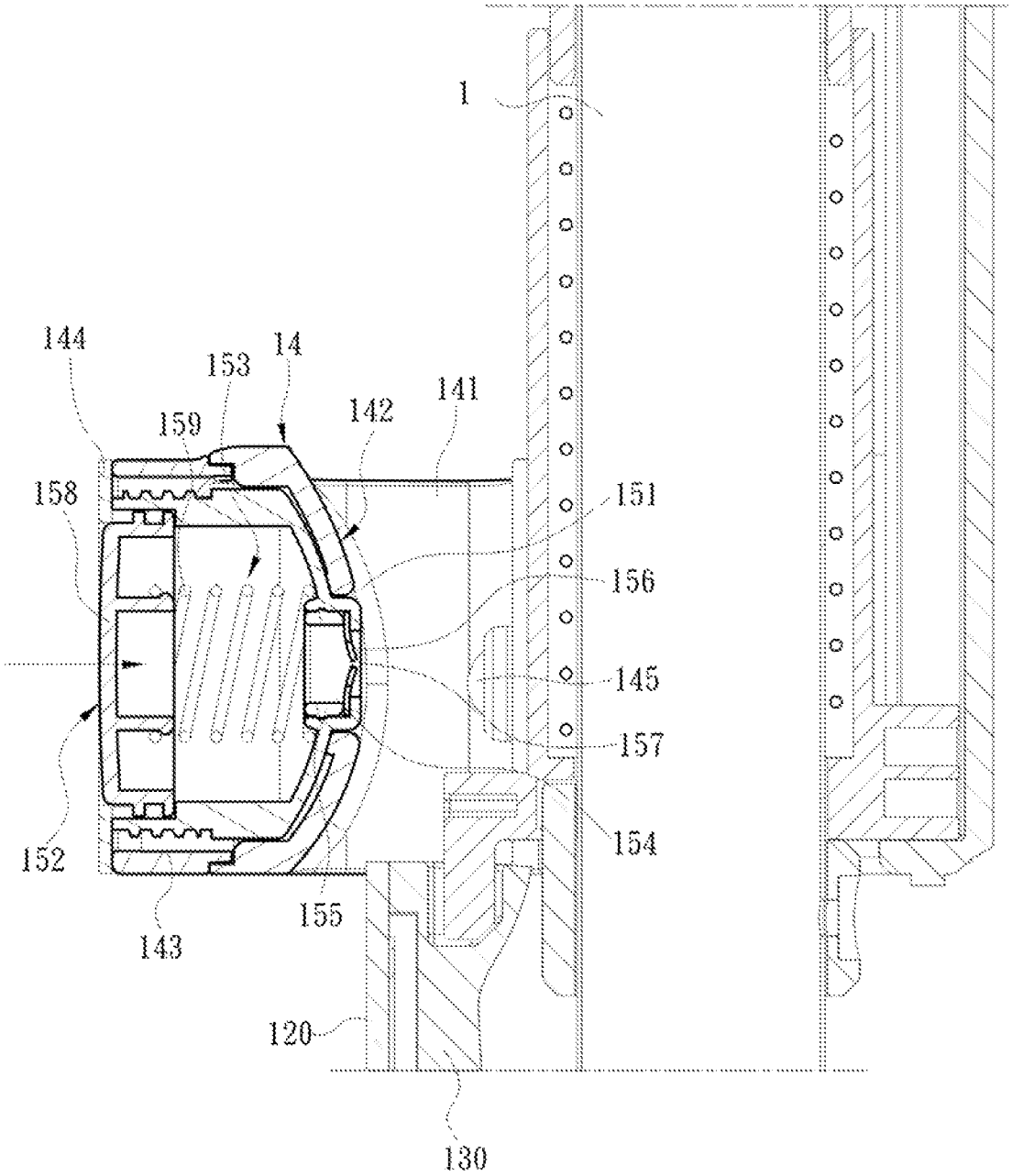
FIG. 22 is another implementation schematic diagram illustrating a partial sectional structure of embodiment 4 of the present invention.

As shown in FIGS. 21-22, the cleaning fluid discharging portion 15 comprising a liquid outlet 151 that is disposed to correspond to the channel 141, a liquid-storing unit 152 that is connected to the liquid outlet 151, and a pair of liquid-supplying control modules 153 that is disposed to correspond to the liquid outlet 151, and can be selected to be open or closed. The liquid-storing unit 152 can be a chamber (not shown) integrally formed by the water-squeezing frame 14, or can be a container (as shown in FIG. 3) attached to the water-squeezing frame 14. The liquid-storing unit 152 is described hereinafter as an embodiment of the container. The container is provided with an opening 154 that is disposed to correspond to the liquid outlet 151. The liquid-supplying control module 153, which is disposed in the container through the opening 154, corresponds to the liquid outlet 151. Further, the liquid-supplying control module 153 is disposed in the opening 154 and seals the end edge of the opening 154, thus merely allowing cleaning fluid to pass through. Further, a portion of the liquid-supplying control module 153 is disposed towards the interior of the container. Furthermore, the liquid-supplying control module 153 comprises a seat tube 155 that corresponds to the opening 154, and a film sheet 156 that is disposed in the seat tube 155 and faces the opening 154. The film sheet 156 is provided with a liquid-discharging slit 157 that can be selected to be open or closed. The container is provided with a button 158 that can be controlled to move towards the opening 154 to change the inner volume of the container, and a spring 159 that is disposed between the button 158 and the seat tube 155 for providing a reset force to the button 158. Specifically, after being assembled, the button 158 can seal one end opening of the container, and appears outside of the container. When the button 158 is pressed to move, the inner volume of the container can be changed, thereby imposing a pressure to the cleaning fluid stored in the container. Thus, the liquid-discharging slit 157 can be open, allowing the cleaning fluid to be sprayed out. Furthermore, the quantity of the cleaning fluid sprayed out can be determined by the pressing force imposed on the button. Moreover, it is not absolutely necessary to dispose one end of the spring 159 on the seat tube 155. In one embodiment, one end of the spring 159 opposite to the button 158 is disposed on the inner wall (not shown) of the container adjacent to the seat tube 155.

Additionally, the liquid can be sprayed manually or automatically. In one embodiment of the present invention, the liquid-supplying control module 153 can be closed and prohibited from providing cleaning fluid to the mop cloth 120 without being triggered by the mop cloth 120, and can be open after being triggered to provide cleaning fluid to the mop cloth 120 while the mop cloth passes through the channel 141. Specifically, the liquid-discharging slit 157 can be triggered to be open while the mop head 130 passes through the channel 141. Namely, when the mop head 130 passes through the channel 141, the mop cloth 120 is squeezed by the channel 141 due to the special shape of the channel 141. During the squeezing process, the film sheet 156 is converted from a closed state into an open state due to the pressure produced in the process of squeezing the mop cloth 120, thereby achieving the purpose of automatically discharging the cleaning fluid.

As shown in FIGS. 21-22, in one embodiment of the present invention, the water-squeezing frame 14 comprises a mounting slot 143 for accommodating the container, and a limiting ring 144 that is disposed on the mounting slot 143 to prevent the button 158 from being separated. Further, the shape of the mounting slot 143 can be adjusted according to the predetermined container, and the inner space of the mounting slot 143 is connected to the liquid outlet 151. Moreover, the limiting ring 144 is placed at a place in the mounting slot that is far from the end portion of the liquid outlet 151. After the limiting ring 144 is assembled, the button 158 can be surrounded by the limiting ring 144, thereby limiting the displacement of the button 158.

As shown in FIG. 22, the liquid-discharging direction of the liquid outlet 151 can be perpendicular to the mop cloth 120 or be tilted relative to the mop cloth 120. Meanwhile, different liquid-discharging directions can affect the spraying range of the cleaning fluid on the mop cloth 120. For instance, when the liquid-discharging direction of the liquid outlet 151 is perpendicular to the mop cloth 120, the spraying range of the cleaning fluid is focused in a single location, and when the liquid-discharging direction of the liquid outlet 151 is tilted to the mop cloth 120, the cleaning fluid can be sprayed to the mop cloth 120 in a wide range. Furthermore, the water-squeezing frame 14 comprises at least one auxiliary rolling wheel 145 that is disposed in the channel 141, and is in contact with the mop head 130 while the mop head 130 passes through the channel 141.

The description of above embodiments allows those skilled in the art to realize or use the present invention. Without departing from the spirit and essence of the present invention, those skilled in the art can combine, change or modify correspondingly according to the present invention. Therefore, the protective range of the present invention should not be limited to the embodiments above but conform to the widest protective range which is consistent with the principles and innovative characteristics of the present invention. Although some special terms are used in the description of the present invention, the scope of the invention should not necessarily be limited by this description. The scope of the present invention is defined by the claims.

The invention claimed is:

1. A water-spraying mop, comprising:

a mop rod, a mop head, and a universal joint that rotationally connects the mop head and the mop rod, wherein the water-spraying mop further comprises a liquid-spraying system consisted of a water tank, a water pump and a dynamic mechanism used for driving the water pump to spray liquid, wherein the water tank for storing water supply is disposed inside the mop head, and the water pump is disposed in the mop rod, wherein the universal joint comprises an upper connector and a lower connector, wherein one end of the upper connector is fixed to the mop rod, the other end of the upper connector is hinged with one end of the lower connector, and the other end of the lower connector is hinged with the mop head, wherein the mop head is provided with an access hole, wherein the water inlet of the water pump and the water tank are connected by a water inlet pipe through the access hole, wherein the middle portion of the lower connector is provided with a first channel for allowing the water inlet pipe to pass through, wherein the water pump is capable of drawing water from mop head up to the mop rod and pumping water back down to the mop head.

2. The water-spraying mop of claim 1, wherein the middle portion of the upper connector is provided with a second channel for allowing the water inlet pipe to pass through.

3. The water-spraying mop of claim 2, wherein the water-spraying mop further comprises a water outlet pipe and a sprayer, wherein one end of the water outlet pipe is connected to the water outlet of the water-spraying pump, and the other end of the water outlet pipe passes through the first channel, and is connected to the sprayer disposed on the mop head.

4. The water-spraying mop of claim 2, wherein the water-spraying mop further comprises a water outlet pipe and a sprayer, wherein one end of the water outlet pipe is connected to the water outlet of the water-spraying pump, and the other end of the water outlet pipe passes through the first channel and the second channel, and is connected to the sprayer disposed on the mop head.

5. The water-spraying mop of claim 1, wherein the mop rod comprises an upper rod body and a lower rod body, wherein a rod-body connecting structure, which allows the upper rod body and the lower rod body to be jointed or separated, is disposed between the upper rod body and the lower rod body, wherein the dynamic mechanism comprises an upper inner rod that is inserted into the upper rod body, a lower inner rod that is inserted into the lower rod body, and a control mechanism capable of propelling the upper inner rod to move in an axial direction, wherein an elastic reset mechanism, which enables the lower inner rod moving downwardly in an axial direction to recover to the original position, is connected to the lower rod body or the lower inner rod, wherein after the upper rod body and the lower rod body are jointed through the rod-body connecting structure, the control mechanism can propel the upper inner rod and the lower inner rod to move together.

6. The water-spraying mop of claim 5, wherein a side portion of a lower end of the lower rod body is provided with an operating hole, wherein an operating body is horizontally disposed in the lower rod body, wherein one end of the operating body penetrates through the operating hole, and the lower inner rod is connected to the operating body.

7. The water-spraying mop of claim 6, wherein the operating hole is a long-type hole that extends along the lower rod body in an axial direction, wherein a travelling space is left between the operating body and the lengthwise direction of the operating hole when the operating body is inserted into the operating hole.

8. The water-spraying mop of claim 6, wherein the elastic reset mechanism comprising a spring that is disposed in the lower rod body, wherein the lower end of the spring acts on the lower rod body, and an upper end of the spring acts on the lower portion of the operating body, wherein the lower end of the lower inner rod acts on the upper portion of the operating body.

9. The water-spraying mop of claim 5, wherein the mop rod is provided with a liquid-spraying base used for mounting the water pump, wherein a first circumferential single-direction positioning structure, which enables the liquid-spraying base to be circumferentially positioned in a single direction relative to the mop rod so that the orientation of the sprayer can be fixed, is disposed between the liquid-spraying base and the mop rod, wherein the control mechanism comprises a handle body and a trigger, wherein a second circumferential single-direction positioning structure, which enables the handle body to be circumferentially positioned in a single direction relative to the mop rod so that the trigger is enabled to face a direction opposite to the sprayer, is disposed between the handle body and the mop rod.

10. The water-spraying mop of claim 9, wherein a third circumferential single-direction positioning structure, which enables the upper rod body to be circumferentially positioned in a single direction relative to the lower rod body, is disposed between the upper rod body and the lower rod body.

11. The water-spraying mop of claim 10, wherein the first circumferential single-direction positioning structure, the second circumferential single-direction positioning structure and the third circumferential single-direction positioning structure can respectively be one or a combination of the structures selecting from a concave-convex type positioning structure, a single-direction engagement structure, a single-direction plug-in structure and single-direction pin-connection structure.

12. The water-spraying mop of claim 11, wherein the first circumferential single-direction positioning structure comprises a positioning cylinder body that is disposed at the upper end of the liquid-spraying base, wherein the lower end of the mop rod is inserted in the positioning cylinder body, wherein the inner side of the positioning cylinder body or the lower end of the mop rod is provided with a first positioning convex portion, wherein an inner side of the positioning cylinder body or the lower end of the mop rod is provided with a first positioning concave portion that can be circumferentially positioned with the first positioning convex portion.

13. The water-spraying mop of claim 12, wherein the first circumferential single-direction positioning structure further comprises a connecting cylinder body that is disposed at the upper portion of the liquid-spraying base and periphery of the positioning cylinder body, wherein the connecting cylinder body is detachably connected to the liquid-spraying base through a single-direction positioning component.

14. The water-spraying mop of claim 13, wherein each single-direction positioning component comprises at least one elastic positioning engagement body that is disposed on the liquid-spraying base, wherein a positioning hole, which corresponds to the elastic positioning engagement body, is provided on the connecting cylinder body, wherein the positioning cylinder body is circumferentially provided with a plurality of positioning slots extending along the connecting cylinder body in an axial direction, and the connecting cylinder body is circumferentially provided with a plurality of positioning convex strips that can match the positioning slots.

15. The water-spraying mop of claim 9, wherein the second circumferential single-direction positioning structure comprises at least one second positioning convex portion that is disposed in the handle body or at the upper portion of the mop rod, wherein the handle body or an upper portion of the mop rod is provided with at least one second positioning concave portion that can coordinate with the second positioning convex portion.

16. The water-spraying mop of claim 1, wherein the mop rod is provided with a liquid-spraying base used for mounting the water pump, wherein a first circumferential single-direction positioning structure, which enables the liquid-spraying base to be circumferentially positioned in a single direction relative to the mop rod so that the orientation of the sprayer can be fixed, is disposed between the liquid-spraying base and the mop rod, wherein a second circumferential single-direction positioning structure, which enables the handle body to be circumferentially positioned in a single direction relative to the mop rod so that the trigger is enabled to face a direction opposite to the sprayer, is disposed between the handle body and the mop rod.

17. The water-spraying mop of claim 1, wherein the mop rod comprises a water-squeezing frame that is disposed on the mop rod, and is capable of moving relative to the mop rod in an axial direction, wherein the water-squeezing frame comprises a channel for allowing the mop head to pass through, and a water-squeezing portion that is disposed in the channel, while the mop head passes through the channel.

18. The water-spraying mop of claim 1, wherein the water-squeezing frame is provided with a cleaning fluid discharging portion that is disposed in the channel, and faces the mop cloth while the mop head passes through the channel, wherein the cleaning fluid is stored in the cleaning fluid discharging portion, wherein the cleaning fluid discharging portion can be controlled to provide cleaning fluid to the channel while the mop head passes through the channel.

19. The water-spraying mop of claim 18, wherein the cleaning fluid discharging portion comprising a liquid outlet that is disposed to correspond to the channel, a liquid-storing unit that is connected to the liquid outlet, and a pair of liquid-supplying control modules that is disposed to correspond to the liquid outlet, and can be selected to be open or closed.

20. The water-spraying mop of claim 19, wherein the liquid-storing unit is a chamber formed by the water-squeezing frame.

21. The water-spraying mop of claim 19, wherein the liquid-storing unit is a container attached to the water-squeezing frame.

22. The water-spraying mop of claim 21, wherein the container is provided with an opening that is disposed to correspond to the liquid outlet, wherein the liquid-supplying control module, which is disposed in the container through the opening, corresponds to the liquid outlet.

23. The water-spraying mop of claim 22, wherein the liquid-supplying control module comprises a seat tube that corresponds to the opening, and a film sheet that is disposed in the seat tube and faces the opening, wherein the film sheet is provided with a liquid-discharging slit that can be selected to be open or closed, wherein the container is provided with a button that can be controlled to move towards the opening to change the inner volume of the container, and a spring that is disposed between the button and the seat tube for providing a reset force to the button.

24. The water-spraying mop of claim 23, wherein the water-squeezing frame comprises a mounting port for mounting the container, a mounting slot that is disposed in the mounting port, and in which the container can be embedded, and a limiting ring that is disposed on the mounting slot to prevent the button from being separated.

25. The water-spraying mop of claim 22, wherein the liquid-supplying control module comprises a seat tube that corresponds to the opening, and a film sheet that is disposed in the seat tube and faces the opening, wherein the film sheet is provided with a liquid-discharging slit that can be selected to be open or closed, wherein the container is provided with a button that can be controlled to move towards the opening to change the inner volume of the container, and a spring capable of providing a reset force to the button, wherein one end of the spring is disposed on the button, and the other end of the spring is disposed on the inner wall of a container adjacent to the seat tube.

* * * * *